US009251990B2

(12) United States Patent
Kobayashi

(10) Patent No.: US 9,251,990 B2
(45) Date of Patent: Feb. 2, 2016

(54) METHOD FOR PRODUCING A THERMOELECTRON EMISSION SOURCE AND METHOD FOR PRODUCING A CATHODE

(71) Applicant: NUFLARE TECHNOLOGY, INC., Kanagawa (JP)

(72) Inventor: Ryoei Kobayashi, Kanagawa (JP)

(73) Assignee: NUFLARE TECHNOLOGY, INC., Kanagawa (JP)

( * ) Notice: Subject to any disclaimer, the term of this patent is extended or adjusted under 35 U.S.C. 154(b) by 0 days.

(21) Appl. No.: 14/459,121

(22) Filed: Aug. 13, 2014

(65) Prior Publication Data

US 2015/0056883 A1 Feb. 26, 2015

(30) Foreign Application Priority Data

Aug. 26, 2013 (JP) ..... 2013-175006

(51) Int. Cl.
*H01J 9/04* (2006.01)

(52) U.S. Cl.
CPC ..... *H01J 9/04* (2013.01)

(58) Field of Classification Search
CPC ..... H01J 9/04; H01J 1/148; H01J 1/13; H01J 37/065; H01J 19/04
See application file for complete search history.

(56) References Cited

U.S. PATENT DOCUMENTS

2005/0174030 A1* 8/2005 Katsap ..... H01J 1/148 313/346 R
2012/0097736 A1* 4/2012 Hultberg ..... B65D 5/0227 229/200

FOREIGN PATENT DOCUMENTS

JP 05-166481 B2 3/2013

OTHER PUBLICATIONS

P.B. Sewell et al., "Study on Thermal Emission in Lanthanum Hexaboride Single Crystal Having Fine Plane", Electron Optical Systems, pp. 163-170, SEM Inc., AMF O'Hare (Chicago), IL 60666-0507, US.

* cited by examiner

*Primary Examiner* — Anne Hines
(74) *Attorney, Agent, or Firm* — Patterson & Sheridan, LLP.

(57) ABSTRACT

A method for producing a thermoelectron emission source for an electron gun used in an electron beam writing apparatus, the thermoelectron emission source producing method comprising, preparing a first material that emits a thermoelectron, coating the first material with a second material having a work function larger than that of the first material, exposing the first material from part of the second material by machine processing, and decreasing a diameter of the exposed portion of the first material by heating treatment when the diameter of the exposed portion is larger than a predetermined diameter value.

12 Claims, 19 Drawing Sheets

Prior Art

Prior Art

METHOD FOR PRODUCING A THERMOELECTRON EMISSION SOURCE AND METHOD FOR PRODUCING A CATHODE

CROSS-REFERENCE TO THE RELATED APPLICATION

The entire disclosure of the Japanese Patent Application No. 2013-175006, filed on Aug. 26, 2013 including specification, claims, drawings, and summary, on which the Convention priority of the present application is based, are incorporated herein in its entirety.

FIELD OF THE INVENTION

The present invention relates to a method for producing a thermoelectron emission source and a method for producing a cathode.

BACKGROUND

Recently, a circuit pattern width required for a semiconductor device becomes narrower with the progress of integration and capacity of a large scale integration (LSI). Using an original pattern (means a mask or a reticle, hereinafter collectively referred to as a mask) in which a circuit pattern is formed, the circuit is formed by exposing and transferring the pattern onto a wafer with a reduction projection aligner called a stepper, thereby producing the semiconductor device. An electron beam writing apparatus that can perform writing of the fine pattern is used in producing the mask used to transfer the fine circuit pattern to the wafer. The electron beam writing apparatus is also used in the case that the circuit pattern is directly drawn in the wafer.

The electron beam writing apparatus inherently provides a superior resolution, since an electron beam used for the electron beam writing apparatus is a charged particle beam. This apparatus is also advantageous in that great depth of focus can be obtained, which enables dimensional variations to be reduced even when a large step feature is encountered. A variably-shaped electron beam writing apparatus that is an example of the electron beam writing apparatus includes an electron gun that emits the electron beam, a first shaping aperture, a second shaping aperture, a shaping deflector, and some electron lenses that causes the electron beam to converge. The electron beam emitted from the electron gun is imaged on the first shaping aperture, and then imaged on the second shaping aperture. The electron beam is deflected with the shaping deflector, and a size and a shape of the electron beam are variably formed by optically superimposing a first shaping aperture image and a second shaping aperture image on each other. The shaped electron beam is shot on the mask that is the writing target, and shot graphics are accurately connected to each other to perform the writing of the pattern.

A thermoelectron emission type electron gun in which a cathode filament is used as a heater can be used as the electron gun of the electron beam writing apparatus. In the electron gun, electrons are emitted by heating a cathode by a filament power. The emitted electrons are accelerated by an acceleration voltage, and controlled by a bias voltage, and the mask is irradiated with the electrons with a predetermined emission current (See Japanese Patent Publication Hei 05-166481).

During writing operation, an area surrounding the electron gun becomes a high vacuum, a high voltage (acceleration voltage) is applied between the cathode and the anode, and the thermoelectron emission source included in the cathode is heated, thereby thermoelectrons are emitted from the thermoelectron emission source. The thermoelectrons are accelerated by the acceleration voltage and emitted as the electron beam.

Lanthanum hexaboride ($LaB_6$) is well known as a material for the thermoelectron emission source. The lanthanum hexaboride ($LaB_6$) has a high melting point and a low work function. The lanthanum hexaboride ($LaB_6$) is relatively stable against residual gas, and has a longer life compared with the case that another material is used. Additionally, because the lanthanum hexaboride ($LaB_6$) has an excellent ion impact resistance, the lanthanum hexaboride ($LaB_6$) is used in not only the electron beam writing apparatus but also a thermoelectron emission emitter such as an electron microscope.

In the electron gun, there is a well-known technology for coating a thermoelectron emission source constituting material with a material having the work function larger than that of the thermoelectron emission source constituting material to restrict an emission area of the electron from the thermoelectron emission source in order to improve luminance. For example, P. B. Sewell et al., "Study on thermal emission in lanthanum hexaboride single crystal having fine plane", Electron Optical Systems, pp. 163-170, SEM Inc., AMF O'Hare (Chicago), IL60666-0507, U.S.A. describes that lanthanum hexaboride ($LaB_6$) is coated with carbon (C). As to the specific coating method, the carbon (C) is deposited on a surface of lanthanum hexaboride ($LaB_6$) by a CVD (Chemical Vapor Deposition) method, a solution containing the carbon (C) is applied onto the surface of lanthanum hexaboride ($LaB_6$), or the lanthanum hexaboride ($LaB_6$) is dipped in the solution. After the coating, the lanthanum hexaboride ($LaB_6$) is exposed from part of the carbon (C) by machine processing, and the electron is emitted through the exposed part.

Accordingly, preferably the conventional thermoelectron emission source constituting the cathode of the electron gun has a structure in which the constituting material such as the lanthanum hexaboride ($LaB_6$) is coated with the carbon (C) layer.

FIG. 18 is a schematic sectional view of the conventional thermoelectron emission source.

As illustrated in FIG. 18, in a conventional thermoelectron emission source 100, surfaces of a cylindrical main body 101 and a conical tip 102 having a flat leading end are coated with a carbon (C) layer 103. For example, the main body 101 and tip 102 of the thermoelectron emission source 100 are integrally formed using the lanthanum hexaboride ($LaB_6$).

The flat leading end of the tip 102 made of the lanthanum hexaboride ($LaB_6$) is exposed from a tip portion of the thermoelectron emission source 100. The structure of the thermoelectron emission source 100 is formed by machine processing such as polishing as mentioned below.

FIG. 19 is a schematic sectional view illustrating a pre-machine processing state of the conventional thermoelectron emission source.

As illustrated in FIG. 19, a thermoelectron emission source constituting material 200 coated with a carbon (C) layer 203 corresponds to the thermoelectron emission source 100 in the pre-machine processing state, that is, before the machine processing such as polishing. For example, the thermoelectron emission source constituting material 200 is subjected to the polishing to become the thermoelectron emission source 100 in FIG. 1.

The thermoelectron emission source constituting material 200 includes a cylindrical main body 201 similar to the main body 101 in FIG. 18 and a conical tip 202 having a sharply pointed shape. The surface of the thermoelectron emission source constituting material 200 is coated with a carbon (C) layer 203. The main body 201 and tip 202 of the thermoelectron emission source constituting material 200 are similar to the main body 101 and tip 102 of the thermoelectron emission source 100 in FIG. 18. For example, the main body 201 and tip 202 are integrally formed using the lanthanum hexaboride ($LaB_6$).

That is, the conical tip 202 of the thermoelectron emission source constituting material 200 has the sharply pointed shape, and the carbon (C) layer 203 coats the conical surface of the tip 202 and the side surface of the main body 201.

Using the thermoelectron emission source constituting material 200 coated with the carbon (C) layer 203, the conventional thermoelectron emission source 100 in FIG. 18 can be produced by the machine processing in which the tip portion of the thermoelectron emission source is polished with a polishing article. In this case, the post-machine processing coating layer 203 becomes the coating layer 103 of the thermoelectron emission source 100 in FIG. 18, and the post-machine processing tip 202 of the thermoelectron emission source constituting material 200 becomes the tip 102 having the flat leading end in FIG. 18. The main body 201 of the thermoelectron emission source constituting material 200 becomes the main body 101 in FIG. 18.

In a method for producing the thermoelectron emission source 100, during the polishing of the thermoelectron emission source constituting material 200 coated with the carbon (C) layer 203, a diameter of the portion exposed from the carbon (C) layer at the leading end of the tip 202 is checked with an optical microscope, and the polishing is repeated when the diameter of the portion exposed is smaller than a predetermined diameter value that is a target value. The conical tip 202 of the thermoelectron emission source constituting material 200 has a cone angle, and the diameter of the portion exposed from the carbon (C) layer, namely, the diameter of the lanthanum hexaboride ($LaB_6$) increases gradually with the progress of the polishing.

In the thermoelectron emission source constituting material 200, the carbon (C) layer 203 is hard to form on the tip 202 made of the lanthanum hexaboride ($LaB_6$) such that a layer thickness becomes uniform. As a result, it is difficult to predict the diameter of the portion exposed from the carbon (C) layer at the leading end of the tip 202 while the tip portion of the thermoelectron emission source constituting material 200 is sharpened by the polishing.

Therefore, as a result of the polishing, sometimes the diameter of the exposed leading end of the tip 102 of the obtained thermoelectron emission source 100, namely, the diameter of the lanthanum hexaboride ($LaB_6$) is larger than the predetermined diameter value. In such cases, the diameter of the exposed leading end cannot be decreased by the similar machine processing such as the polishing. That is, in the method for producing the thermoelectron emission source 100, in the case that the leading end of the tip 102 is excessively polished by the machine processing in order to expose the leading end of the tip 102 from the carbon (C) layer 103, the leading end of the tip 102 is hardly repaired.

Accordingly, in the case that the tip is excessively polished in producing the thermoelectron emission source 100, it is necessary to discard the thermoelectron emission source 100 as a product that does not satisfy a specification. During the production of the thermoelectron emission source 100, in the case that the leading end of the tip 102 that is exposed from the carbon (C) layer and made of the lanthanum hexaboride ($LaB_6$) is larger than the predetermined diameter value, it is necessary to discard the thermoelectron emission source 100. As a result, a yield is degraded in the production of the thermoelectron emission source 100.

In the case that the cathode of the electron gun is produced by incorporating the thermoelectron emission source 100 in the cathode, productivity of the cathode is degraded when the production yield of the thermoelectron emission source 100 is degraded.

Therefore, there is a demand for a yield improving technology in the method for producing the thermoelectron emission source constituting the cathode of the electron gun. Additionally, there is also a demand for a production efficiency improving technology in the method for producing the cathode used in the electron gun.

The present invention has been made in view of the above problems. Namely, an object of the invention is to provide a thermoelectron emission source producing method that improves the production yield.

Further, an object of the invention is to provide a cathode producing method that improves the production efficiency.

Other challenges and advantages of the present invention are apparent from the following description.

SUMMARY OF THE INVENTION

According to one aspect of the present invention, a method for producing a thermoelectron emission source for an electron gun used in an electron beam writing apparatus comprising, preparing a first material that emits a thermoelectron, coating the first material with a second material having a work function larger than that of the first material, exposing the first material from part of the second material by machine processing, and decreasing a diameter of the exposed portion of the first material by providing heating treatment to the first material when the diameter of the exposed portion is larger than a predetermined diameter value.

Further to this aspect of the present invention, a thermoelectron emission source producing method, wherein the first material is metal hexaboride or tungsten.

Further to this aspect of the present invention, a thermoelectron emission source producing method, wherein the second material is a carbon (C) material.

In another aspect of the present invention, a method for producing a thermoelectron emission source for an electron gun used in an electron beam writing apparatus comprising, preparing a first material that emits a thermoelectron, coating the first material with a second material having a work function larger than that of the first material, exposing the first material from part of the second material by machine processing such that a diameter of the exposed portion of the first material is larger than a predetermined diameter value, and decreasing the exposed portion of the first material by providing heating treatment to the first material such that the diameter of the exposed portion of the first material becomes the predetermined diameter value.

Further to this aspect of the present invention, a thermoelectron emission source producing method, wherein the first material is metal hexaboride or tungsten.

Further to this aspect of the present invention, a thermoelectron emission source producing method, wherein the second material is a carbon (C) material.

In another aspect of the present invention, method for producing a thermoelectron emission source for an electron gun used in an electron beam writing apparatus comprising, preparing a first material that emits a thermoelectron, wherein the first material including a cylindrical main body and a conical tip having a flat leading end, forming a sacrifice film on a surface of the tip of the first material, coating an outer circumferential surface of the main body of the first material and a conical surface of the tip of the first material with a second material having a work function larger than that of the first material, removing the sacrifice film to expose the leading end of the tip of the first material from the second material, and forming a gap between the conical surface of the tip of the first material and the second material, and decreasing a diameter of the exposed leading end of the tip of the first material by providing heating treatment to the first material when the diameter of the exposed leading end is larger than a predetermined diameter value.

Further to this aspect of the present invention, a thermoelectron emission source producing method, wherein the first material is metal hexaboride or tungsten.

Further to this aspect of the present invention, a thermoelectron emission source producing method, wherein the second material is a carbon (C) material.

Further to this aspect of the present invention, a thermoelectron emission source producing method, wherein the sacrifice film is an organic film.

In another aspect of the present invention, a method for producing a cathode for an electron gun used in an electron beam writing apparatus comprising, preparing a thermoelectron emission source in which a first material that emits a thermoelectron is exposed from part of a second material having a work function larger than that of the first material while the first material is coated with the second material, forming a cathode structure by incorporating the thermoelectron emission source in the cathode structure, and forming the thermoelectron emission surface by providing heating treatment to the first material of the cathode structure such that a diameter of the exposed portion of the first material of the thermoelectron emission source incorporated in the cathode structure becomes a predetermined diameter value by decreasing the diameter of the exposed portion.

Further to this aspect of the present invention, a cathode producing method, further comprising adjusting a height of the electron emission surface after the heating treatment.

DETAILED DESCRIPTION OF THE EMBODIMENTS

A thermoelectron emission source according to the first embodiment of the present invention is heated to emit thermoelectrons. The thermoelectron emission source according to the first embodiment of the present invention is produced by a thermoelectron emission source producing method according to the second embodiment of the present invention. A thermoelectron emission unit constituting material according to the third embodiment of the present invention, and a thermoelectron emission unit constituting material on which a coating layer is formed according to the fourth embodiment of the present invention, can be used to the thermoelectron emission source producing method according to the second embodiment of the present invention. Further the thermoelectron emission source according to the first embodiment of the present invention, can be used to a cathode of an electron gun according to the fifth embodiment of the present invention. Accordingly, the thermoelectron emission source according to the first embodiment of the present invention, can be used to an electron gun for an electron beam writing apparatus according to the sixth embodiment. The cathode of the fifth embodiment of the present invention is produced by a cathode producing method according to the seventh embodiment of the present invention. In order to emit an electron beam that is a charged particle beam, the electron gun for an electron beam writing apparatus according to the sixth embodiment of the present embodiment, includes a cathode of the fifth embodiment of the present embodiment that is an electron source, and an anode including a ground electrode.

Figure 1:
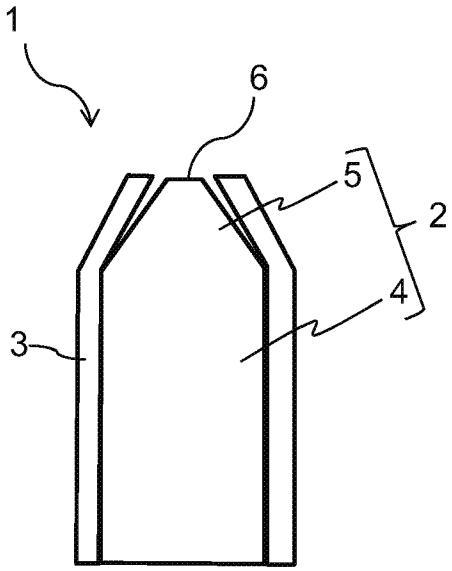
FIG. 1 is a schematic sectional view of an example of a thermoelectron emission source according to a first embodiment of the present invention.

FIG. 1 is a schematic sectional view of a first example of a thermoelectron emission source according to a first embodiment of the present invention.

As illustrated in FIG. 1, a thermoelectron emission source 1 of the first example according to the first embodiment is configured such that a thermoelectron emission unit 2 is coated with a coating layer 3. The thermoelectron emission unit 2 of the thermoelectron emission source 1 includes a cylindrical main body 4 and a tip 5 in which a leading end is formed into a flat conical shape.

In the thermoelectron emission source 1, the main body 4 and tip 5 of the thermoelectron emission unit 2 can integrally be formed using an identical constituting material. The thermoelectron emission source 1 has a height of about 0.5 mm to about 3 mm, and the main body 4 of the thermoelectron emission unit 2 has a diameter of about 200 μm to about 800 μm. A cone angle of the tip 5 is preferably in a range from 20 degrees to 90 degrees, more preferably in a range from 60 degrees to 90 degrees.

In the main body 4 and tip 5 constituting the thermoelectron emission unit 2 of the thermoelectron emission source 1, metal hexaboride and tungsten, which emit the thermoelectron, can be cited as an example of a constituting material for the main body 4 and tip 5. Examples of the metal hexaboride include lanthanum hexaboride ($LaB_6$), cerium hexaboride ($CeB_6$), gadolinium hexaboride ($GdB_6$), and yttrium hexaboride ($YB_6$). The lanthanum hexaboride ($LaB_6$) is more preferably selected as the constituting material for the main body 4 and tip 5. The lanthanum hexaboride ($LaB_6$) has a high melting point and a low work function. In the case that the lanthanum hexaboride ($LaB_6$) is used in the thermoelectron emission source 1, the lanthanum hexaboride ($LaB_6$) is relatively stable against residual gas, and has a longer life compared with the case that another material is used. Additionally, the lanthanum hexaboride ($LaB_6$) is preferably selected as it has an excellent ion impact resistance.

A coating layer 3 of the thermoelectron emission source 1 is made of a material having the work function larger than that of the main body 4 and tip 5 constituting the thermoelectron emission unit 2 of the thermoelectron emission source 1. An area where the electron is emitted from thermoelectron emission source 1 can be restricted by the coating of the material, and luminance of the electron gun including the thermoelectron emission source 1 can be improved.

Carbon (C) materials such as graphite, colloidal graphite, diamond-like carbon, and pyrolytic graphite can be cited as an example of a material constituting the coating layer 3.

In the thermoelectron emission source 1, the coating layer 3 coats an outer circumferential surface of the main body 4 and a conical surface of the tip 5 of the thermoelectron emission unit 2. The coating layer 3 coats the outer circumferential surface of the main body 4 while being in direct contact with the outer circumferential surface. On the other hand, the coating layer 3 coats the conical surface of the tip 5 while being not in direct contact with the conical surface but a gap is formed.

The flat leading end of the tip 5 of the thermoelectron emission unit 2 is exposed from a tip portion of the thermoelectron emission source 1 to form an electron emission surface 6.

The electron emission surface 6 provided at the leading end of the tip 5 of the thermoelectron emission source 1 in FIG. 1 has the flat shape as described above. Alternatively, the electron emission surface 6 may have a spherical shape.

The electron emission surface 6 of the thermoelectron emission source 1 is preferably formed into a circular shape in planar view. In this case, the diameter of the electron emission surface 6 is set to a predetermined diameter value that becomes a target value of design. For example, the diameter of the electron emission surface 6 can be set within a range of 5 μm to 200 μm. The predetermined diameter value has an allowable range, and the range of ±10% around an ideal diameter value of design becomes the predetermined diameter value. That is, the predetermined diameter value becomes one having the allowable range (ideal diameter value ±10%).

A size of the thermoelectron emission source 1 is adjusted during the production such that the electron emission surface 6 has the predetermined diameter value that is the target value. As a result, in the tip 5, the conical surface is not direct contact with the coating layer 3, but the gap is formed as illustrated in FIG. 1.

A method for producing the thermoelectron emission source 1 of the first embodiment will be described below.

Figure 2:
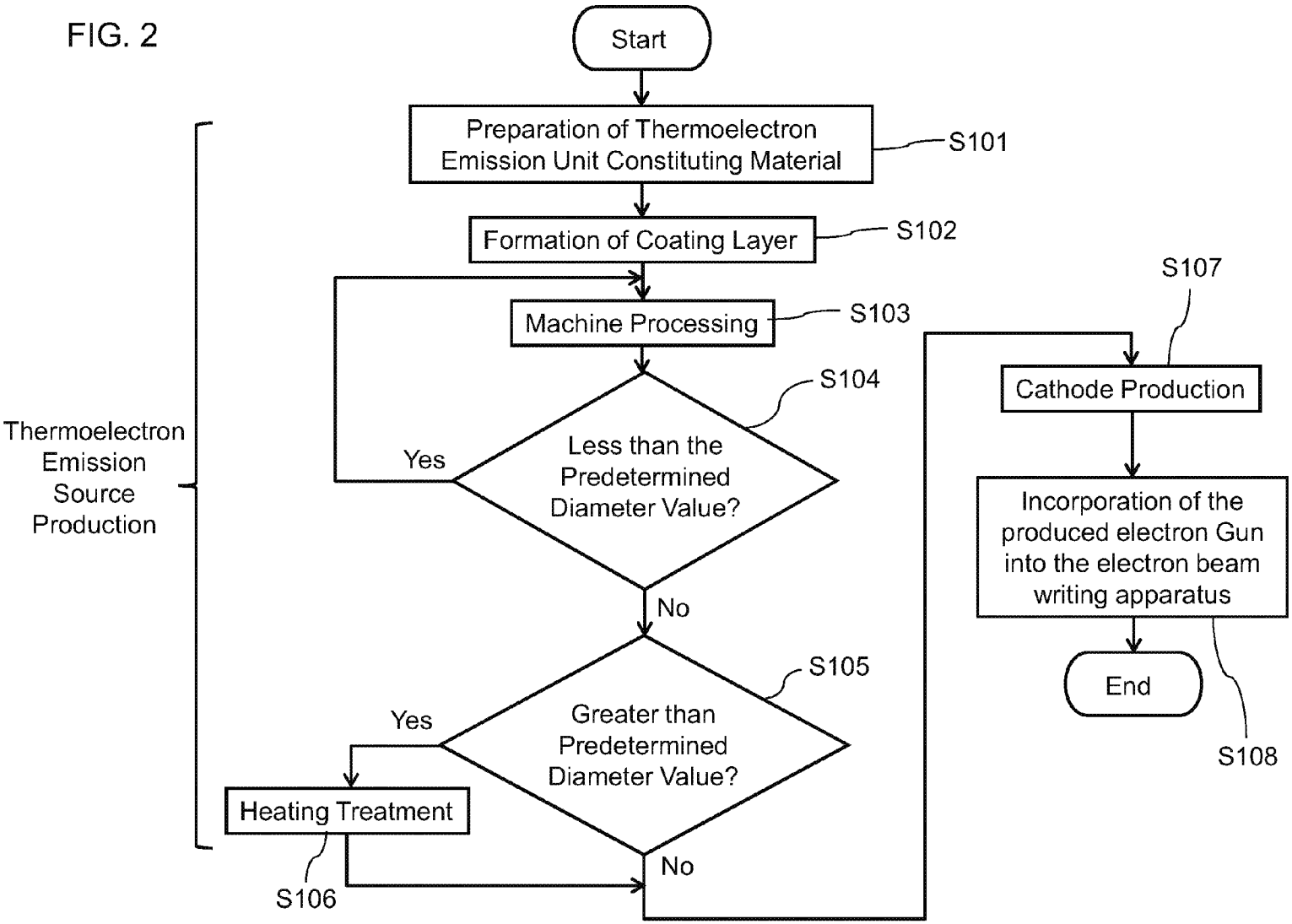
FIG. 2 is a flowchart illustrating a first example of the method for producing the thermoelectron emission source according to the second embodiment of the present invention.

FIG. 2 is a flowchart illustrating a first example of the method for producing the thermoelectron emission source of a second embodiment of the present invention.

The method for producing the thermoelectron emission source of the second embodiment will be described with reference to FIGS. 1 and 2 by taking the method for producing the thermoelectron emission source 1 as an example. FIG. 2 also illustrates a method for producing the cathode in which the thermoelectron emission source 1 is used, and a method for producing an electron beam writing apparatus by producing the electron gun in which the cathode is incorporated.

As illustrated in FIG. 2, in the first example of the method for producing the thermoelectron emission source of the second embodiment, a thermoelectron emission unit constituting material emitting the thermoelectron is prepared (S101). The thermoelectron emission unit constituting material is a member used to form the thermoelectron emission unit 2 of the thermoelectron emission source 1. For example, the thermoelectron emission unit constituting material is made of the lanthanum hexaboride ($LaB_6$). In this case, the thermoelectron emission unit 2 of the thermoelectron emission source 1 is made of the lanthanum hexaboride ($LaB_6$).

Figure 3:
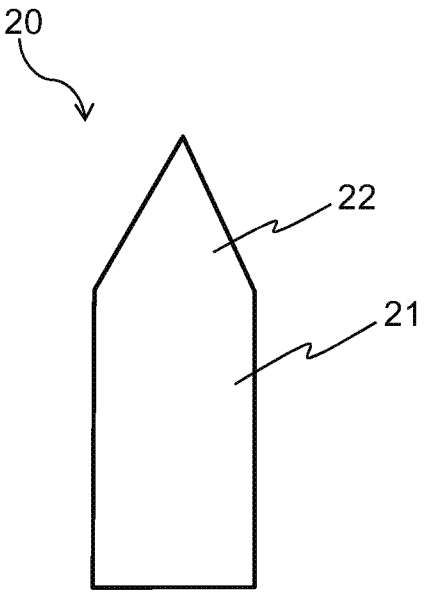
FIG. 3 is a schematic sectional view illustrating the thermoelectron emission unit constituting material according to the third embodiment of the present invention.

FIG. 3 is a schematic sectional view illustrating the thermoelectron emission unit constituting material of a third embodiment of the present invention.

A thermoelectron emission unit constituting material 20 in FIG. 3 corresponds to the thermoelectron emission unit 2 of the thermoelectron emission source 1 in pre-machine processing state. For example, the thermoelectron emission unit constituting material 20 is subjected to the machine processing, such as polishing, and constitutes the thermoelectron emission unit 2 in FIG. 1.

The thermoelectron emission unit constituting material 20 includes a cylindrical main body 21 constituting the main body 4 of the thermoelectron emission unit 2 of the thermoelectron emission source 1 in FIG. 1 and a conical tip 22 having a sharply pointed shape. As described later with reference to FIG. 4, the tip 22 is subjected to the machine processing such as the polishing after being coated with a coating layer 23, and the tip 22 constitutes the tip 5 of the thermoelectron emission unit 2 of the thermoelectron emission source 1 in FIG. 1.

The main body 21 and tip 22 of the thermoelectron emission unit constituting material 20 are similar to the main body 4 and tip 5 of the thermoelectron emission source 1 in FIG. 1. For example, the main body 21 and tip 22 are integrally formed using the lanthanum hexaboride ($LaB_6$). At this point, the thermoelectron emission unit constituting material 20 has the sharply pointed shape.

Figure 4:
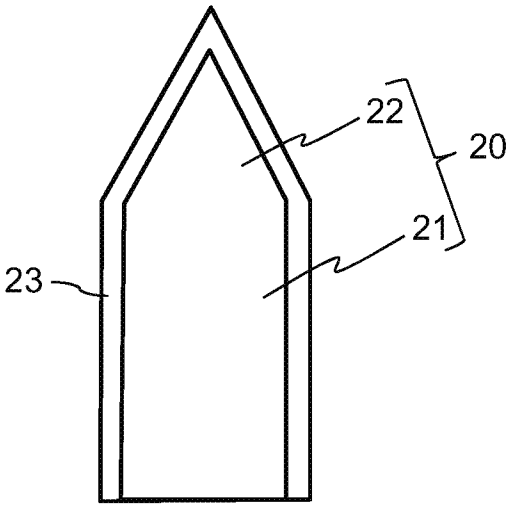
FIG. 4 is a schematic sectional view illustrating the thermoelectron emission unit constituting material in which the coating layer according to the fourth embodiment of the present invention is formed.

FIG. 4 is a schematic sectional view illustrating the thermoelectron emission unit constituting material in which the coating layer of a fourth embodiment of the present invention is formed.

As illustrated in the flowchart of FIGS. 2 and 4, a coating layer 23 is formed on a surface of the thermoelectron emission unit constituting material 20 to coat the surface of the thermoelectron emission unit constituting material 20 (S102). Preferably the coating layer 23 is made of a material having the work function larger than that of the thermoelectron emission unit constituting material 20. That is, in the process of Step S102, the thermoelectron emission unit constituting material 20 is coated with the material having the work function larger than that of the thermoelectron emission unit constituting material 20.

For example, the carbon (C) material can be used as the constituting material for the coating layer 23. In this case, for example, the coating layer 23 is formed on the surface of the thermoelectron emission unit constituting material 20 by forming the carbon (C) on the surface of the thermoelectron emission unit constituting material 20 by a CVD (Chemical Vapor Deposition) method, by applying a solution containing the carbon (C) onto the surface of the thermoelectron emission unit constituting material 20, or by dipping the thermoelectron emission unit constituting material 20 in the solution.

As a result, the thermoelectron emission unit constituting material 20 on which the coating layer 23 is formed corresponds to the thermoelectron emission source 1 in the pre-machine processing state. FIG. 4 is a schematic sectional view illustrating the pre-machine processing state of the thermoelectron emission source of the first embodiment of the present invention.

That is, in the thermoelectron emission source 1 in the pre-machine processing state, the conical tip 22 of the thermoelectron emission unit constituting material 20 has the sharply pointed shape, and the coating layer 23 coats the whole conical surface of the tip 22 made of the lanthanum hexaboride ($LaB_6$) and the whole side surface of the main body 21 made of the lanthanum hexaboride ($LaB_6$).

The leading end of the thermoelectron emission unit constituting material 20 on which the coating layer 23 is formed is polished by the machine processing such as mechanical grinding and mechanical polishing, and the tip 22 of the thermoelectron emission unit constituting material 20 is exposed from part of the coating layer 23 (S103). In the case that the thermoelectron emission unit constituting material 20 is subjected to the polishing, for example, a grinder or a file may be used.

Figure 5:
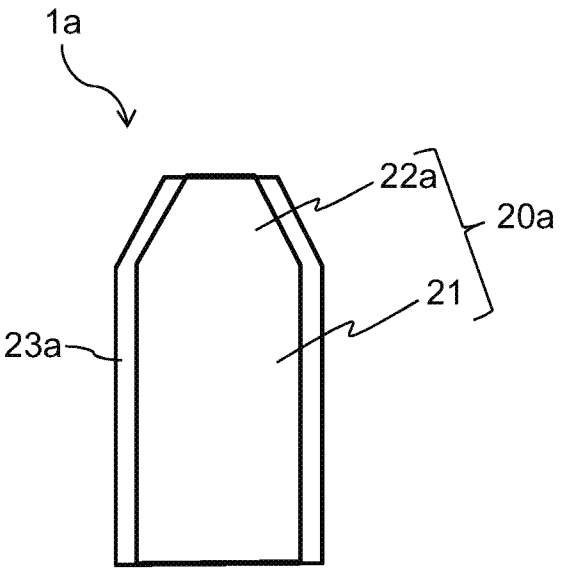
FIG. 5 is a schematic sectional view illustrating a first example of the pre-heating treatment state of the thermoelectron emission source according to the first embodiment of the present invention.

As a result, a thermoelectron emission unit constituting material 20*a* and a coating layer 23*a* in FIG. 5, which are subjected to the machine processing, constitute a thermoelectron emission source 1*a*. Then, in the first example of the method for producing the thermoelectron emission source of the second embodiment, heating treatment is performed as required. In producing the thermoelectron emission source 1, the thermoelectron emission source 1*a* corresponds to a preheating treatment state of the thermoelectron emission source 1.

FIG. 5 is a schematic sectional view illustrating the preheating treatment state of the thermoelectron emission source of the first embodiment of the present invention.

The tip portion of the thermoelectron emission unit constituting material 20 and the coating layer 23, as shown in FIG. 4, is sharpened from the leading end side by mechanical grinding or mechanical polishing as illustrated in FIG. 5. The coating layer 23 is polished to constitute the coating layer 23*a*, and the thermoelectron emission unit constituting material 20 is polished to constitute the thermoelectron emission unit constituting material 20*a*, thereby forming the thermoelectron emission source 1*a*. In the thermoelectron emission source 1*a*, the flat leading end of the tip 22*a* of the thermoelectron emission unit constituting material 20*a* is exposed from part of the coating layer 23*a*. The thermoelectron emission unit constituting material 20*a* of the thermoelectron emission source 1*a* in FIG. 5 corresponds to the thermoelectron emission unit 2 of the thermoelectron emission source 1 in the pre-heating treatment state, and the thermoelectron emission unit constituting material 20*a* is subjected to the heating treatment as needed basis to constitute the thermoelectron emission unit 2 in FIG. 1.

At this point, a size of the exposed flat leading end of the tip 22*a* of the thermoelectron emission source 1*a* is adjusted by the heating treatment. That is, the tip 22*a* is formed such that a diameter at the exposed flat leading end (hereinafter simply referred to as a leading end diameter) has a predetermined value, thereby constituting the electron emission surface 6 in FIG. 1.

After the machine processing, whether the value of the leading end diameter of the tip 22*a* is smaller than the predetermined diameter value that is the target value of design is checked as illustrated in the flowchart of FIG. 2 (S104). For example, the leading end diameter can be checked with an optical microscope.

When the value of the leading end diameter is not smaller than the predetermined diameter value that is the target value, the flow process moves to Step 5105 to check whether the value of the leading end diameter is larger than a next predetermined diameter value.

On the other hand, when the value of the leading end diameter is smaller than the predetermined diameter value that is the target value, the flow process returns to Step S103 to further perform the machine processing. As illustrated in FIGS. 3 and 4, the conical tip 22 of the thermoelectron emission unit constituting material 20 has the cone angle, the diameter of the leading end exposed from the coating layer 23, namely, the leading end diameter of the tip 22*a* increases gradually with the progress of the polishing.

Accordingly, the leading end diameter of the tip 22*a* can be increased by repeating the machine processing such as the mechanical grinding and the mechanical polishing after the flow process returns to Step S103.

As illustrated in the flowchart of FIG. 2, whether the value of the leading end diameter of the tip 22*a* of the thermoelectron emission source 1*a* is smaller than the predetermined diameter value that is the target value of design is checked again. The machine processing of the thermoelectron emission unit constituting materials 20 and 20*a* and the check of the leading end diameter of the tip 22*a* are repeatedly performed until the value of the leading end diameter becomes smaller than the predetermined diameter value.

When the value of the leading end diameter of the tip 22*a* is not smaller than the predetermined diameter value that is the target value, whether the value of the leading end diameter of the tip 22*a* is larger than the predetermined diameter value that is the target value is checked (S105).

When the checked value of the leading end diameter of the tip 22*a* becomes the predetermined diameter value that is the target value, the thermoelectron emission source producing process is ended, and the flow process moves to a next cathode producing process in Step S107.

On the other hand, when the checked value of the leading end diameter of the tip 22*a* is larger than the predetermined diameter value that is the target value, a heating treatment process is provided to perform the heating treatment for the thermoelectron emission unit constituting material 20*a* (S106). In the heating treatment, the tip 22*a* of the thermoelectron emission source 1*a* is sublimed to adjust the size of the flat leading end that is the exposed portion of the tip 22*a*. That is, the tip 22*a* is sublimed through the heating treatment, and the size is adjusted such that the leading end diameter is decreased. By providing the heating treatment to the tip 22*a*, the size of it is adjusted such that the leading end diameter becomes the predetermined diameter value that is the target value.

For example, in the case that the predetermined diameter value is set to 100 μm±5 μm with respect to the leading end diameter of the tip 22*a*, the size is adjusted by about 5 μm to about 10 μm through the heating treatment.

In the heating treatment, preferably a condition is selected such that the coating layer 23*a* does not sublime and deform.

The heating treatment condition can properly be selected according to the thermoelectron emission unit constituting material 20*a* or the constituting material for the coating layer 23*a* of the thermoelectron emission source 1*a*. As to a temperature condition, when a heating temperature is extremely low, the size cannot be adjusted such that the leading end diameter is decreased. On the other hand, when a heating temperature is extremely high, a crystalline property of the lanthanum hexaboride ($LaB_6$) constituting the tip 22*a* is lost thus decreasing an electron emission characteristic.

Accordingly, in the heating treatment, the thermoelectron emission source 1*a* is heated at a temperature lower than a temperature at which the coating layer 23*a* made of the carbon (C) material is evaporated, and heated at a temperature lower than a melting point of the material, such as the lanthanum hexaboride ($LaB_6$), which constitutes the thermoelectron emission unit constituting material 20*a*.

The heating treatment temperature condition can be decided in consideration of an actual operating condition of the electron beam writing apparatus of the including the electron gun in which the thermoelectron emission source 1 is incorporated. For example, the heating treatment can be performed at a temperature close to the actual operating condition of the electron beam writing apparatus of the sixth embodiment including the electron gun of the fifth embodiment in which the thermoelectron emission source 1 is incorporated. More specifically, the heating treatment can be performed in a range of ±200° C. around an operating temperature of the electron gun including the cathode provided with the thermoelectron emission source 1.

Although a heating time can be shortened when a pressure is enhanced during the heating, preferably the heating is performed at a pressure close to the actual operating condition of the electron beam writing apparatus. For example, the writing is performed with the electron beam at pressures of $1\times10^{-5}$ Pa to $1\times10^{-4}$ Pa and at a temperature of about 1750K. Therefore, the heating treatment is preferably performed under the similar condition. Specifically, the heating treatment is preferably performed at pressure less than or equal to $1\times10^{-4}$ Pa and at temperatures of 1500K to 1900K.

In the embodiments, as described above, materials other than the lanthanum hexaboride ($LaB_6$) can be used as the material constituting the thermoelectron emission unit 2 of the thermoelectron emission source 1 in FIG. 1. In such cases, the heating treatment condition is properly changed. High electric conductivity and mechanical strength and chemical stability at high temperature are required for the constituting material for the thermoelectron emission unit 2. At this point, the mechanical strength and chemical stability at high temperature can be achieved by a material having a high melting point. Specifically, the high melting point means one that is higher than the operating temperature of the electron beam writing apparatus.

As described above, metal hexaboride such as cerium hexaboride ($CeB_6$), gadolinium hexaboride ($GdB_6$), and yttrium hexaboride ($YB_6$) can be cited as the material that satisfies the high electric conductivity and the mechanical strength and chemical stability at the high temperature and has the work function comparable to the lanthanum hexaboride ($LaB_6$). Tungsten (W) can also be used as the constituting material for the thermoelectron emission unit 2. The tungsten (W) has the higher melting point compared with the lanthanum hexaboride ($LaB_6$) and the cerium hexaboride ($CeB_6$), so that the tungsten (W) can be subjected to the heating treatment at a temperature of, for example, about 2000K.

The thermoelectron emission source 1 that is a first example of the first embodiment of the present invention as shown in FIG. 1 can be obtained through the heating treatment. In the obtained thermoelectron emission source 1, the thermoelectron emission unit 2 is coated with the coating layer 3, and the flat leading end of the tip 5 of the thermoelectron emission unit 2 is exposed from the tip portion of the thermoelectron emission source 1 to constitute the electron emission surface 6.

The coating layer 3 coating the thermoelectron emission unit 2 of the thermoelectron emission source 1 that is the first example of the first embodiment of the present invention, is made of the carbon (C) material as one example. Alternatively, the coating layer 3 may be made of a material other than the carbon (C) material. However, the coating layer 3 is preferably made of a material that is mechanically and chemically stable during the operation of the electron beam writing apparatus and has the larger work function compared with the electron emission material, such as lanthanum hexaboride ($LaB_6$), which constitutes the thermoelectron emission unit 2. For example, the coating layer 3 is made of a material having the work function of about 1.5 times to about 2 times larger than lanthanum hexaboride ($LaB_6$).

After the heating treatment, the cathode is produced by a well-known method using the produced thermoelectron emission source 1 of the first example of the first embodiment of the present invention (S107).

Figure 6:
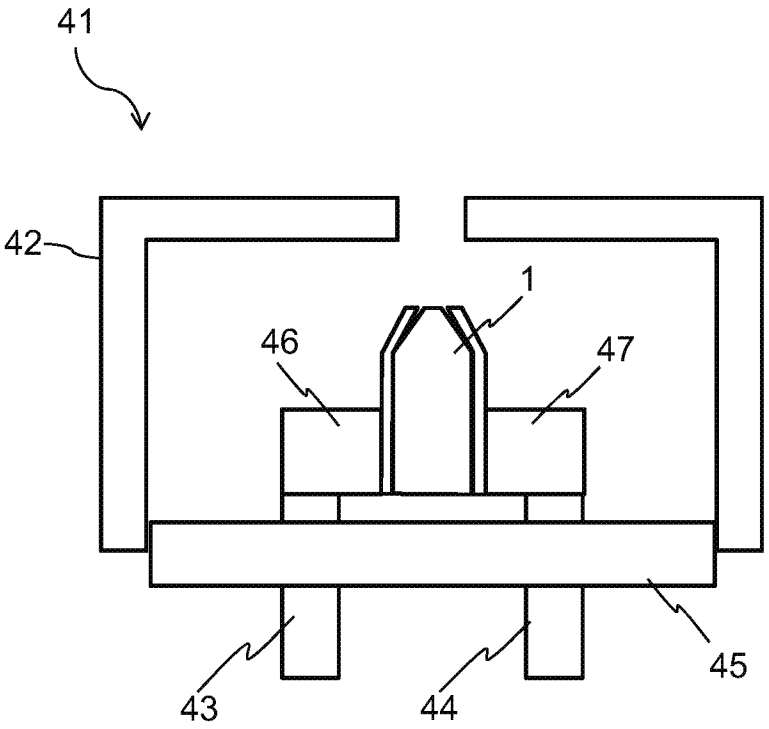
FIG. 6 is a schematic sectional view illustrating a structure of the cathode according to the fifth embodiment of the present invention.

FIG. 6 is a schematic sectional view illustrating a structure of the cathode of a fifth embodiment of the present embodiment.

As illustrated in FIG. 6, a cathode 41 of the fifth embodiment includes the thermoelectron emission source 1 of the first example of the first embodiment that emits the electron, a Wehnelt 42 that causes the electron emitted from the thermoelectron emission source 1 to converge while an electrical potential lower than a voltage applied to the thermoelectron emission source 1 is provided, and a base 45 that supports heater power input terminals 43 and 44. The Wehnelt 42 is arranged so as to surround the thermoelectron emission source 1, and includes an opening through which an electron beam emitted from the thermoelectron emission source 1 passes. A diameter of the opening of the Wehnelt 42 is selected so as to cause the electron beam to converge properly. The thermoelectron emission source 1 is supported on the base 45 while supported by the heater power input terminals 43 and 44, and the thermoelectron emission source 1 can be heated by heaters 46 and 47.

The electron gun is produced using the produced cathode, and the electron beam writing apparatus can be produced by incorporating the obtained electron gun (S108). A well-known method can be applied to the electron gun and electron beam writing apparatus producing method in Step S108.

Figure 7:
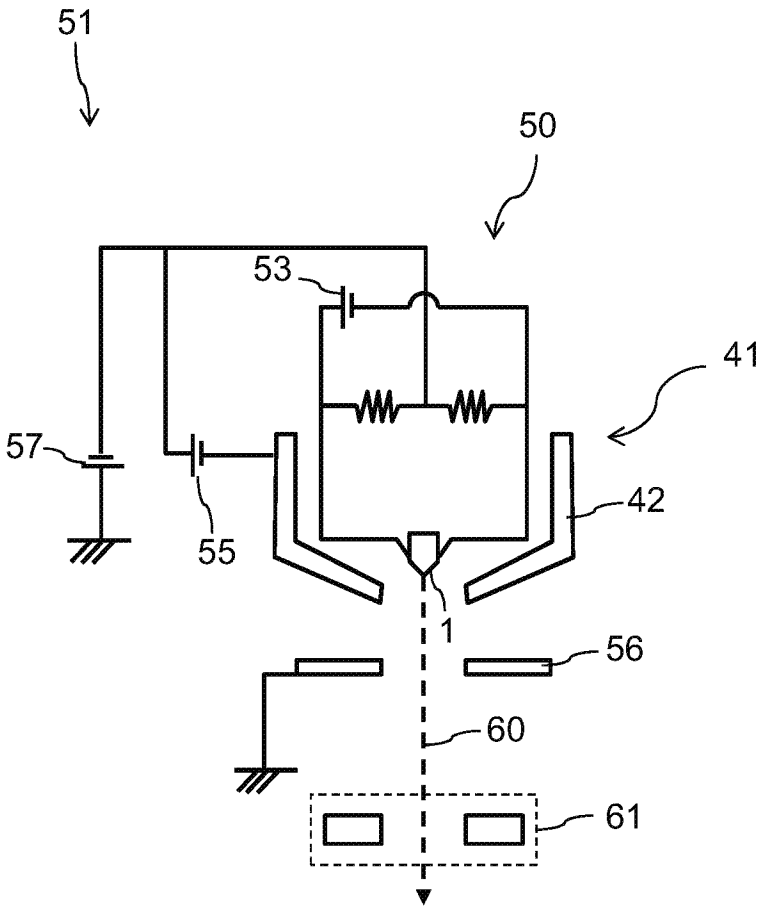
FIG. 7 is a view mainly illustrating a configuration of a thermoelectron emission type electron gun of the electron beam writing apparatus according to the sixth embodiment of the present invention.

FIG. 7 is a view mainly illustrating a configuration of a thermoelectron emission type electron gun of the electron beam writing apparatus of the sixth embodiment of the present invention.

As illustrated in FIG. 7, an electron gun 50 incorporated in an electron beam writing apparatus 51 includes the cathode 41 and an anode 56.

As illustrated in FIG. 6, the cathode 41 of the electron gun 50 includes the thermoelectron emission source 1 of the first example of the first embodiment, that is an electron source, the base 45 that supports the thermoelectron emission source 1, and the Wehnelt 42 that causes the electron emitted from the thermoelectron emission source 1 to converge. The anode 56 is arranged below the Wehnelt 42 including the cathode 41.

As illustrated in FIG. 7, the thermoelectron emission source 1 of the cathode 41 is connected to a heater power supply 53, which is used to heat the thermoelectron emission source 1, through the heaters 46 and 47 (not illustrated in FIG. 7) to form a heater circuit. For example, in the case that a filament is used as the heater, the heater power supply 53 becomes a filament power supply, and the heater circuit becomes a filament circuit.

As described above, the Wehnelt 42 is arranged so as to surround the thermoelectron emission source 1. The Wehnelt 42 includes the opening located below the thermoelectron emission source 1, and controls the electron emitted from the thermoelectron emission source 1 by causing the electron to converge. A bias power supply 55 is connected to the Wehnelt 42 in order to apply a bias with the thermoelectron emission source 1, thereby forming a bias circuit.

An acceleration power supply 57 is connected to the anode 56, the heater circuit, and the bias circuit in order to apply an acceleration voltage between the thermoelectron emission source 1 and the anode 56 to supply an emission current.

A surrounding of the electron gun 50 becomes high vacuum during writing operation of the electron beam writing apparatus 51 in which the electron gun 50 is incorporated. At this point, a high voltage (acceleration voltage) of, for example, about 50 kV is applied between the cathode 41 and the anode 56 using the acceleration power supply 57. On the other hand, by applying a heating voltage between the heater power input terminals 43 and 44 (not illustrated in FIG. 7) using the heater power supply 53, the heaters 46 and 47 (not illustrated in FIG. 7) are energized to heat the thermoelectron emission source 1. Therefore, the thermoelectron is emitted from the thermoelectron emission source 1, and the thermoelectron is accelerated by the acceleration voltage and emitted as an electron beam 60.

The electron beam 60 is shaped into a necessary shape by an electron beam control system 61, such as various lenses, various deflectors, and a beam shaping aperture, which is provided in the electron beam writing apparatus 51. A sample (not illustrated) in a sample chamber (not illustrated) arranged below the electron beam writing apparatus 51 is irradiated with the shaped electron beam 60, thereby performing writing of a pattern in the sample.

For the first example of the method for producing the thermoelectron emission source of the second embodiment described with reference to FIG. 2, in Step S103, the machine processing is performed such that the value of the leading end diameter of the tip 22*a* of the thermoelectron emission unit constituting material 20 becomes the predetermined diameter value. Therefore, whether the value of the leading end diameter of the tip 22*a* of the thermoelectron emission unit constituting material 20 is larger than the predetermined diameter value that is the target value is checked in Step S105, and the heating treatment (S106) is performed only when the value of the leading end diameter is larger than the predetermined diameter value that is the target value.

Alternatively, in the method for producing the thermoelectron emission source of the second embodiment, the machine processing may be performed such that the value of the leading end diameter of the tip 22*a* of the thermoelectron emission unit constituting material 20 is larger than the predetermined diameter value at the beginning, and then the heating treatment may be performed.

Figure 8:
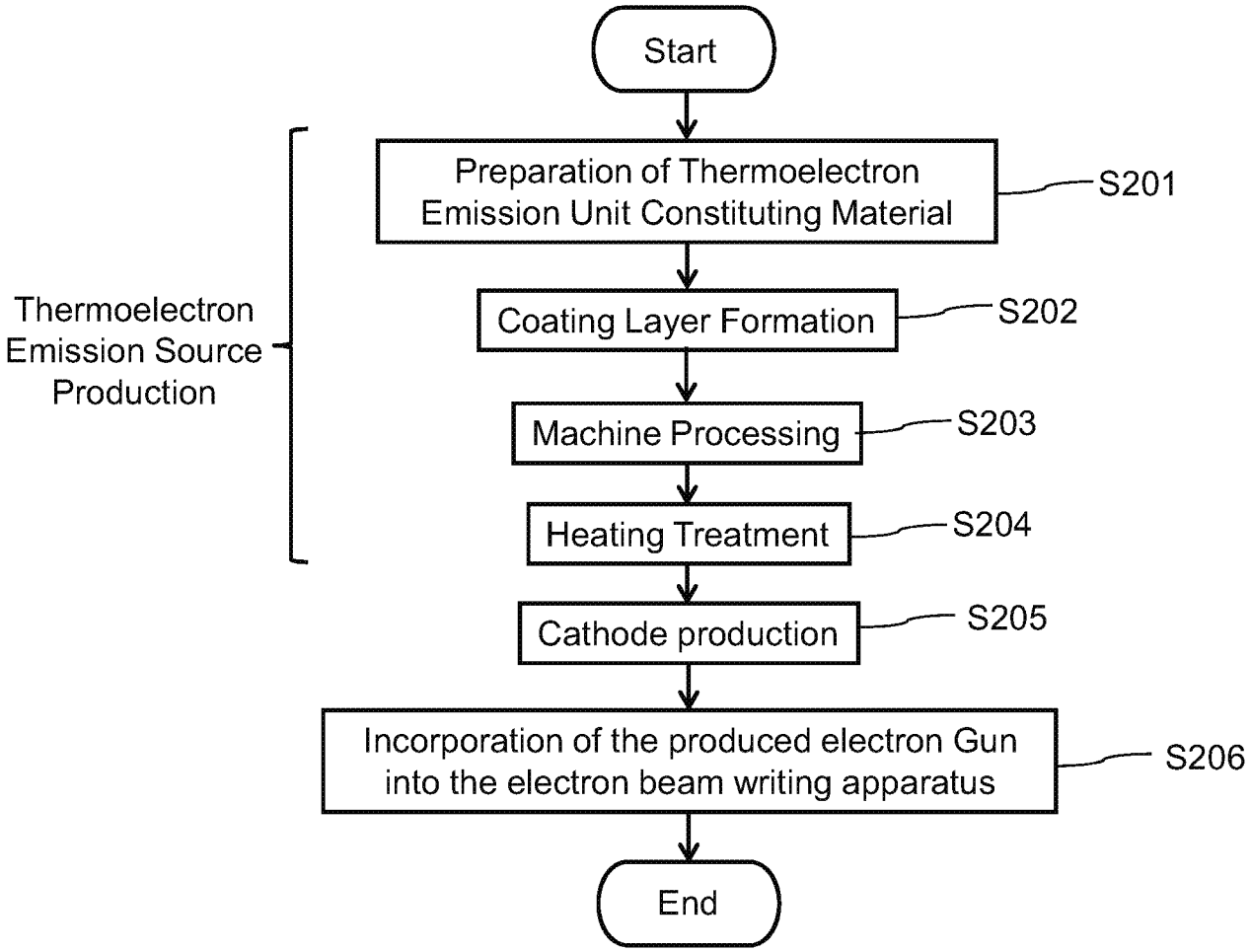
FIG. 8 is a flowchart illustrating a second example of the method for producing the thermoelectron emission source 1 according to the second embodiment of the present invention.

FIG. 8 is a flowchart illustrating a second example of the method for producing the thermoelectron emission source 1 of the second embodiment of the present invention.

The second example of the method for producing the thermoelectron emission source of the second embodiment in FIG. 8 includes the production processes similar to those of the first example of the method for producing the thermoelectron emission source of the second embodiment of the present invention as shown in FIG. 2. For example, the preparation of the thermoelectron emission unit constituting material in FIG. 8 (S201) is similar to Step S101 of the first example in FIG. 2, the formation of the coating layer (S202) is similar to Step S102 of the first example in FIG. 2, the heating treatment (S204) is similar to Step S106 of the first example in FIG. 2, the production of the cathode (S205) is similar to Step S107 of the first example in FIG. 2, and the incorporation of the electron gun in the electron beam writing apparatus (S206) is similar to Step S108 of the first example in FIG. 2. Accordingly, repeated descriptions will be avoided as much as possible.

In the second example of the method for producing the thermoelectron emission source of the second embodiment, the thermoelectron emission unit constituting material is prepared (S201), and the coating layer is formed by coating the thermoelectron emission unit constituting material with the material having the work function larger than that of the thermoelectron emission unit constituting material (S202). As illustrated in FIG. 4, before the thermoelectron emission source 1 is subjected to the machine processing, the conical tip 22 of the thermoelectron emission unit constituting material 20 has the sharply pointed shape, and the coating layer 23 coats the whole conical surface of the tip 22 and the whole side surface of the main body 21, which are made of, for example, lanthanum hexaboride ($LaB_6$).

Then the leading end of the thermoelectron emission unit constituting material 20 on which the coating layer 23 is formed is polished by the machine processing such as the mechanical grinding and the mechanical polishing to form the thermoelectron emission source 1*a* in FIG. 5, and the tip 22*a* of the thermoelectron emission unit constituting material 20*a* is exposed from part of the coating layer 23*a* (S203). In the case that the polishing is performed to the thermoelectron emission unit constituting material 20, for example, a grinder or a file may be used.

As a result, the thermoelectron emission unit constituting material 20*a* and coating layer 23*a* that are subjected to the machine processing constitute the thermoelectron emission source 1*a*. Then, the heating treatment is performed in the second example of the method for producing the thermoelectron emission source of the second embodiment. The thermoelectron emission source 1*a* corresponds to the thermoelectron emission source 1 in the pre-heating treatment state in producing the thermoelectron emission source 1.

In the thermoelectron emission unit constituting material 20 and coating layer 23 in FIG. 4, the tip portion is polished from the leading end side by the mechanical grinding or the mechanical polishing as illustrated in FIG. 5. As a result, the coating layer 23 is polished to become the coating layer 23*a*, and the thermoelectron emission unit constituting material 20 is also polished to become the thermoelectron emission unit constituting material 20*a*, thereby forming the thermoelectron emission source 1*a*. In the thermoelectron emission source 1*a*, the flat leading end of the tip 22*a* of the thermoelectron emission unit constituting material 20*a* is exposed from part of the coating layer 23*a*.

At this point, in the second example of the method for producing the thermoelectron emission source of the second embodiment, the machine processing is performed such that the value of the leading end diameter of the tip 22*a* of the thermoelectron emission unit constituting material 20*a* is larger than the predetermined diameter value. Then, the thermoelectron emission unit constituting material 20*a* in FIG. 5 is subjected to the heating treatment to constitute the thermoelectron emission unit 2 in FIG. 1.

The exposed flat leading end of the tip 22*a* is adjusted such that the size is decreased through the heating treatment. That is, the value of the leading end diameter of the tip 22*a* is adjusted so as to become the predetermined diameter value that is the target value. The flat leading end of the tip 22*a* constitutes the electron emission surface 6 in FIG. 1. As a result, the thermoelectron emission source 1 of the first example of the first embodiment of the present invention can be obtained.

After the thermoelectron emission source 1 of the first example of the first embodiment is obtained through the heating treatment, the cathode is produced by a well-known method using the produced thermoelectron emission source 1 (S205).

Then, the electron gun is produced using the produced cathode, and the electron beam writing apparatus can be produced by incorporating the obtained electron gun in the electron beam writing apparatus (S206). A well-known method can be applied to the method for producing the electron gun and the electron beam writing apparatus in Step S206.

As described above, in the method for producing the thermoelectron emission source of the second embodiment, in the case that the thermoelectron emission source 1 is produced, the heating treatment process is provided, and the leading end diameter of the tip 22*a* of the thermoelectron emission unit constituting material 20*a* of the thermoelectron emission source 1*a* is adjusted to form the electron emission surface 6 in FIG. 1. However, in the method for producing the thermoelectron emission source of the second embodiment, the structures of the thermoelectron emission unit constituting material and the coating layer are not limited to those in FIG. 5. In producing the thermoelectron emission source, the post-machine processing state, namely, the pre-heating treatment state is not limited to that in FIG. 5.

Figure 9:
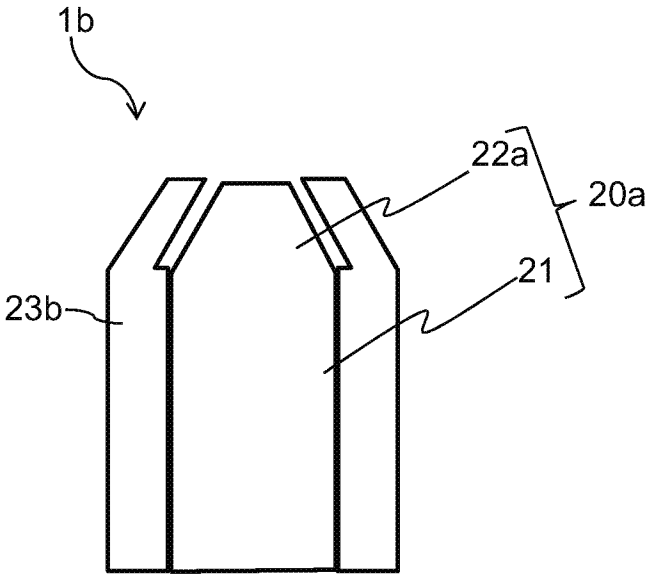
FIG. 9 is a schematic sectional view illustrating a second example of pre-heating treatment state of a thermoelectron emission source according to a first embodiment of the present invention.

FIG. 9 is a schematic sectional view illustrating the second example of pre-heating treatment state of a thermoelectron emission source according to the first embodiment of the present invention.

As illustrated in FIG. 9, a thermoelectron emission source 1*b* that corresponds to another example of the pre-heating treatment state of the thermoelectron emission source of a second embodiment includes the thermoelectron emission unit constituting material 20*a* and a coating layer 23*b*. The thermoelectron emission unit constituting material 20*a* includes the cylindrical main body 21 and the conical tip 22*a* having the flat leading end. In the thermoelectron emission unit constituting material 20*a* and the coating layer 23*b*, a gap having high uniformity is previously formed between the conical surface of the tip 22*a* and the coating layer 23*b*, the leading end diameter of the tip 22*a* is adjusted by performing the heating treatment, and another example of the thermoelectron emission source of the first embodiment of the present invention can be produced.

A method for forming the thermoelectron emission unit constituting material 20*a* and the coating layer 23*b* with the gap in the tip portion in FIG. 9 will be described below.

Figure 10:
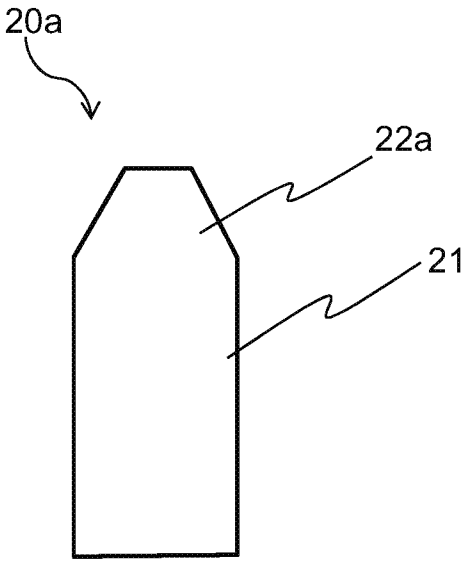
FIG. 10 is a schematic sectional view illustrating a structure of the thermoelectron emission unit constituting material used to produce the thermoelectron emission source.

FIG. 10 is a schematic sectional view illustrating a structure of the thermoelectron emission unit constituting material used to produce the thermoelectron emission source.

The thermoelectron emission unit constituting material 20*a* is prepared. The thermoelectron emission unit constituting material 20*a* includes the cylindrical main body 21 that constitutes the main body 4 of the thermoelectron emission unit 2 of the thermoelectron emission source 1 in FIG. 1 and the conical tip 22*a* having the flat leading end. For example, the thermoelectron emission unit constituting material 20 having the sharply pointed shape in FIG. 3 is prepared, subjected to the machine processing such as the polishing, and polished from the leading end side, thereby obtaining the thermoelectron emission unit constituting material 20*a*.

Then a sacrifice film 71 is formed on the surface of the thermoelectron emission unit constituting material 20*a*.

Figure 11:
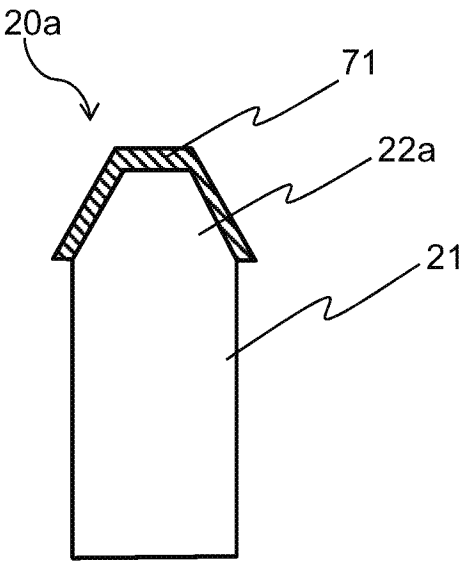
FIG. 11 is a schematic sectional view illustrating the thermoelectron emission unit constituting material in which the sacrifice film is formed.

FIG. 11 is a schematic sectional view illustrating the thermoelectron emission unit constituting material in which the sacrifice film is formed.

As illustrated in FIG. 11, preferably the sacrifice film 71 is formed on the surface of the tip 22*a* of the thermoelectron emission unit constituting material 20*a*. Preferably the sacrifice film 71 can be removed from the thermoelectron emission unit constituting material 20*a* without affecting the thermoelectron emission unit constituting material 20*a*. Various organic films can be used as the sacrifice film 71. For example, acrylic resin and cellulose nitrate can be used as the constituting material for the sacrifice film 71.

Then the coating layer 23*b* is formed on the thermoelectron emission unit constituting material 20*a* and the sacrifice film 71.

Figure 12:
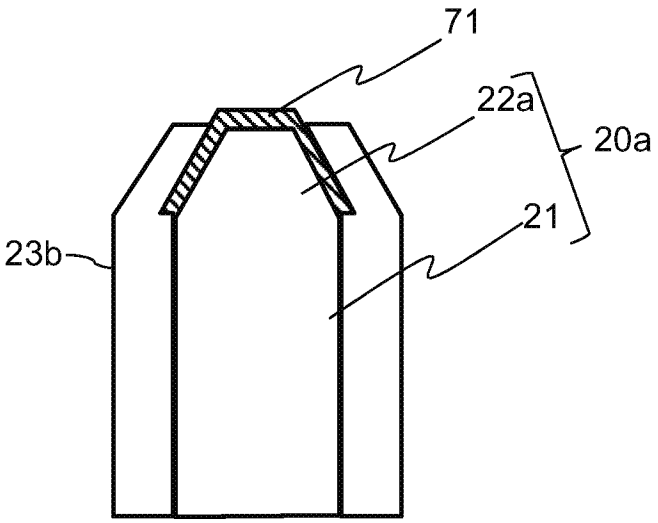
FIG. 12 is a schematic sectional view illustrating the thermoelectron emission unit constituting material and sacrifice film on which the coating layer is formed.

FIG. 12 is a schematic sectional view illustrating the thermoelectron emission unit constituting material and sacrifice film on which the coating layer is formed.

For example, the coating layer 23*b* can be formed by vapor deposition. At this point, the coating layer 23*b* is formed only on the outer circumferential surface of the main body 21 and the conical surface of the tip 22*a* of the thermoelectron emission unit constituting material 20*a*, but not formed on the surface on the leading end side of the tip 22*a* that constitutes the electron emission surface later.

Then the thermoelectron emission unit constituting material 20*a* and coating layer 23*b* that include the gap in the tip portion in FIG. 9 are obtained by removing the sacrifice film 71. At this point, the sacrifice film 71 is removed such that the thermoelectron emission unit constituting material 20*a* and the coating layer 23*b* are not damaged. The sacrifice film 71 can be removed by various methods. For example, a heating method is effectively used in the case that the sacrifice film 71 is an organic film. In this case, preferably the heating temperature is set to a range of 300° C. to 600° C.

The thermoelectron emission unit constituting material 20*a* and coating layer 23*b* that include the highly uniform gap in the tip portion in FIG. 9 can be formed by the above method, and the thermoelectron emission source 1*b* can be obtained.

The heating treatment similar to the heating treatment (S106) in the first example of the method for producing the thermoelectron emission source of the second embodiment is performed to adjust the leading end diameter of the tip 22*a*, and the thermoelectron emission source of the second example of the first embodiment of the present invention can be obtained.

Figure 13:
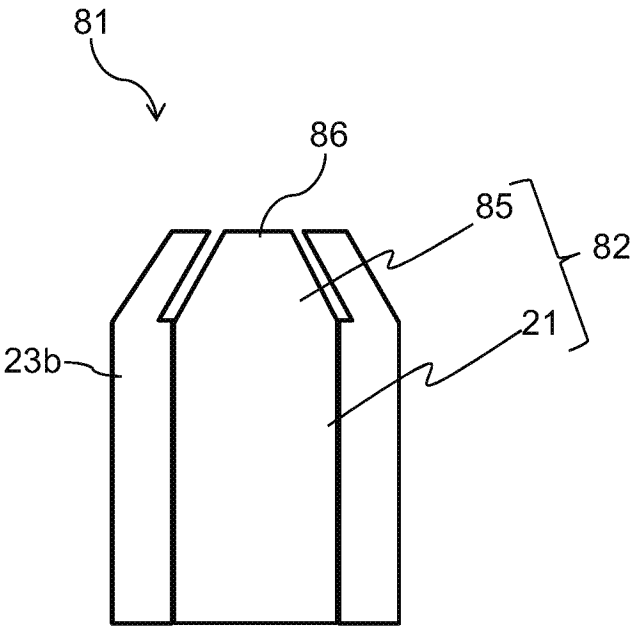
FIG. 13 is a schematic sectional view illustrating a second example of a thermoelectron emission source according to the first embodiment of the present invention.

FIG. 13 is a schematic sectional view illustrating a second example of a thermoelectron emission source according to the first embodiment of the present invention.

A thermoelectron emission source 81 of the second example of the first embodiment has a shape similar to that of the thermoelectron emission source 1*b* in FIG. 9, and the thermoelectron emission source 81 differs from the thermoelectron emission source 1*b* in a structure of a thermoelectron emission unit 82 in which a tip 85 is formed.

As illustrated in FIG. 13, in the thermoelectron emission source 81 of the second example of the first embodiment, the thermoelectron emission unit 82 is coated with the coating layer 23*b*. The thermoelectron emission unit 82 of the thermoelectron emission source 81 includes the cylindrical main body 21 and the conical tip 85 having the sharply pointed shape. At this point, the main body 21 of the thermoelectron emission unit 82 corresponds to the main body 21 of the thermoelectron emission unit constituting material 20*a* in FIGS. 9 and 10. The tip 85 is formed from the tip 22*a* of the thermoelectron emission unit constituting material 20*a* in FIGS. 9 and 10 through the heating treatment.

In the tip portion of the thermoelectron emission source 81, the flat leading end of the tip 85 of the thermoelectron emission unit 82 constitutes an electron emission surface 86. A gap is formed between the conical surface of the tip 85 of the electron emission unit 82 and the coating layer 23*b*. Preferably the gap has widths of about 1 μm to about 10 μm and depths of about 10 μm to about 200 μm in a vertical direction in FIG. 13.

As described above, in the thermoelectron emission source of the second example of the first embodiment, the uniform gap can previously be formed between the conical surface of the tip of the thermoelectron emission unit and the coating layer at the production stage. The thermoelectron emission source includes the electron emission surface having the desired diameter, and uniformity of an electric field distribution can be enhanced at the leading end of the thermoelectron emission source when the thermoelectron emission source is incorporated in the electron gun.

In the method for producing the thermoelectron emission source of the second embodiment of the present invention, the method for producing the thermoelectron emission source 1 is described with reference to FIG. 2 as one example, and the method for producing the cathode using the thermoelectron emission source 1 is also described.

That is, in the method, the leading end diameter of the tip of the thermoelectron emission source is adjusted through the heating treatment to form the electron emission surface having the desired diameter, and the cathode is produced by incorporating the thermoelectron emission source including the electron emission surface in the cathode. At this point, in the invention, the process of adjusting the leading end diameter of the tip of the thermoelectron emission source through the heating treatment is not limited so as to be provided in the process of producing the thermoelectron emission source. That is, the process of adjusting the leading end diameter of the tip of the thermoelectron emission source through the heating treatment can also be provided in the process of producing the cathode.

The cathode producing method according to a seventh embodiment of the present invention including the process of forming or adjusting the electron emission surface of the thermoelectron emission source will be described below.

Figure 14:
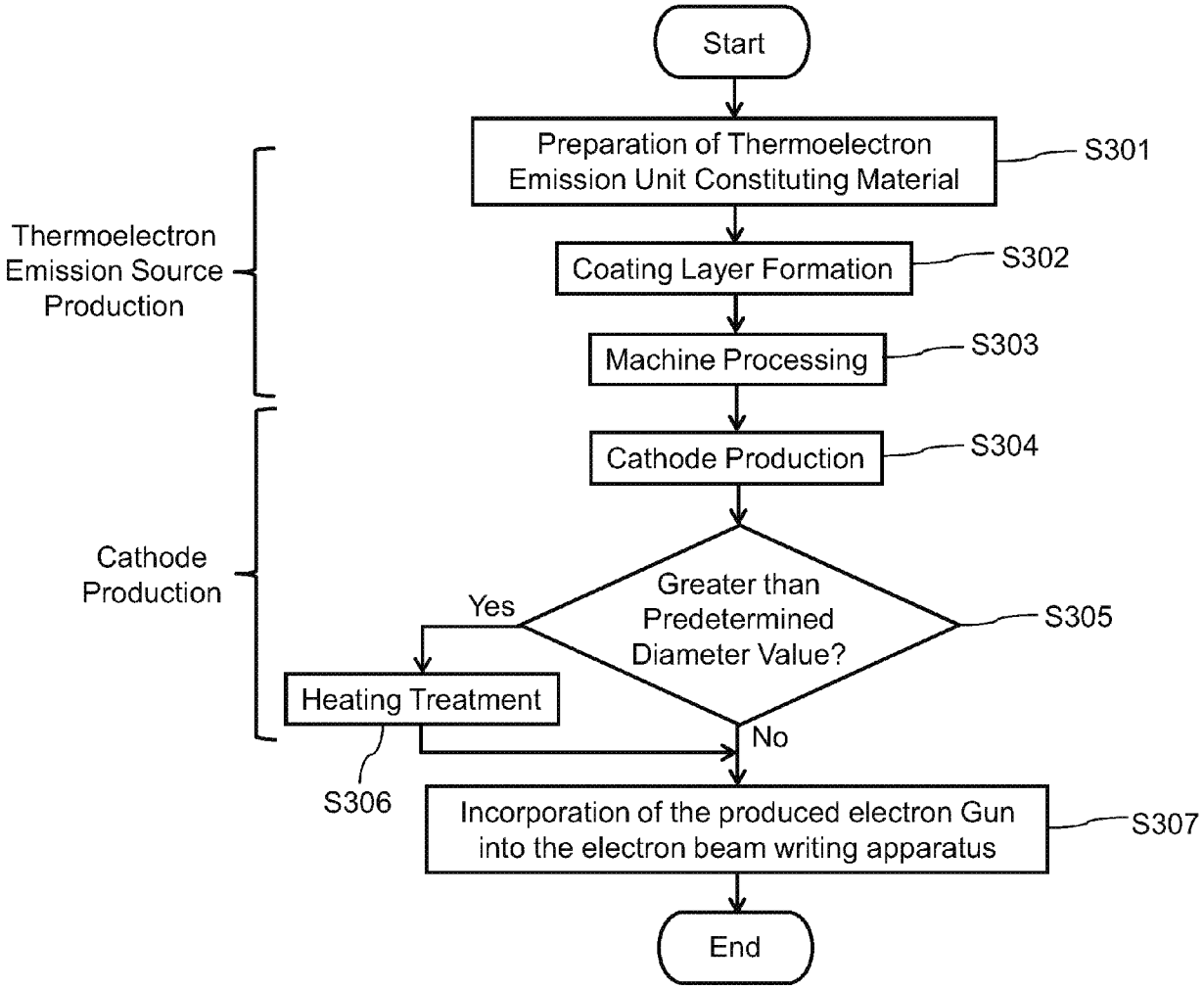
FIG. 14 is a flowchart illustrating the cathode producing method according to the seventh embodiment of the present invention.

FIG. 14 is a flowchart illustrating the cathode producing method of the seventh embodiment of the present invention.

The cathode producing method of the seventh embodiment in FIG. 14 includes the process similar to the first example of the method for producing the thermoelectron emission source of the second embodiment in FIG. 2. For example, the preparation of the thermoelectron emission unit constituting material in FIG. 14 (S301) is similar to Step S101 of the thermoelectron emission source producing method in FIG. 2, the formation of the coating layer (S302) is similar to Step S102 of the thermoelectron emission source producing method in FIG. 2, the machine processing (S303) is similar to Step S103 of the thermoelectron emission source producing method in FIG. 2, the specific temperature condition of the heating treatment (S306) is similar to Step S106 of the thermoelectron emission source producing method in FIG. 2, and the incorporation of the electron gun in the electron beam writing apparatus (S307) is similar to Step S108 of the thermoelectron emission source producing method in FIG. 2. Accordingly, repeated descriptions will be avoided as much as possible In the cathode producing method of the embodiments, the thermoelectron emission source is produced, and the cathode of the embodiments is produced using the produced thermoelectron emission source.

In the cathode producing method of the seventh embodiment of the present invention, the thermoelectron emission unit constituting material is prepared (S301), and the thermoelectron emission unit constituting material is coated with the material having the work function larger than that of the thermoelectron emission unit constituting material to form the coating layer (S302). As illustrated in FIG. 4, before the thermoelectron emission source 1 is subjected to the machine processing, the conical tip 22 of the thermoelectron emission unit constituting material 20 has the sharply pointed shape, and the coating layer 23 coats the whole conical surface of the tip 22 and the whole side surface of the main body 21, which are made of, for example, lanthanum hexaboride ($LaB_6$).

Then the leading end of the thermoelectron emission unit constituting material 20 on which the coating layer 23 is formed is polished by the machine processing such as the mechanical grinding and the mechanical polishing to form the thermoelectron emission source 1*a* in FIG. 5, and the tip 22*a* of the thermoelectron emission unit constituting material 20 is exposed from part of the coating layer 23*a* (S303). In the case that the polishing is performed to the thermoelectron emission unit constituting material 20, for example, a grinder or a file may be used.

As a result, the thermoelectron emission source 1*a* formed by the machine processing corresponds to the thermoelectron emission source 1 in the pre-heating treatment state of the thermoelectron emission source 1 in FIG. 5.

In the thermoelectron emission unit constituting material 20 in which the coating layer 23 is formed, the tip portion is polished from the leading end side by the mechanical grinding or the mechanical polishing as illustrated in FIG. 5. As a result, the coating layer 23 is polished to become the coating layer 23*a*, the thermoelectron emission unit constituting material 20 is also polished to become the thermoelectron emission unit constituting material 20*a*, and the flat leading end of the tip 22*a* of the thermoelectron emission unit constituting material 20*a* is exposed from part of the coating layer 23*a*.

At this point, in the cathode producing method of the embodiments, preferably the machine processing is performed such that the value of the leading end diameter of the tip 22*a* of the thermoelectron emission unit constituting material 20*a* of the thermoelectron emission source 1*a* is larger than the predetermined diameter value.

After the thermoelectron emission source 1*a* in FIG. 5 that is the pre-heating treatment state of the thermoelectron emission source 1 is obtained, the cathode is produced by a well-known method using the thermoelectron emission source 1*a* (S304).

Figure 15:
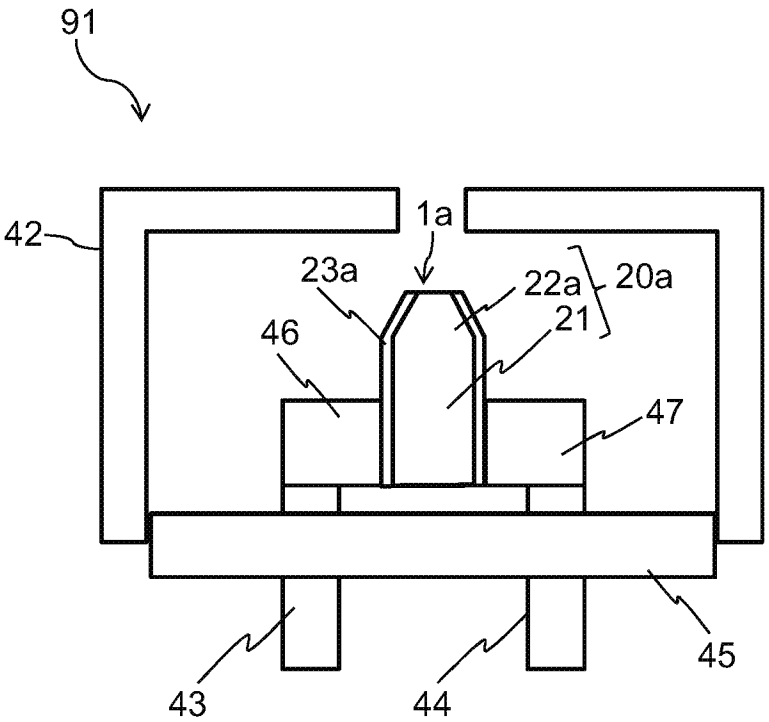
FIG. 15 is a schematic sectional view illustrating a cathode structure formed using the thermoelectron emission source in the pre-heating treatment state.

FIG. 15 is a schematic sectional view illustrating a cathode structure formed using the thermoelectron emission source in the pre-heating treatment state.

The cathode structure in FIG. 15 is formed using the thermoelectron emission source 1*a* that is not subjected to the heating treatment. Hereinafter, the cathode structure in FIG. 15 is referred to as a cathode 91 for the sake of convenience.

When the cathode 91 in FIG. 15 formed using the thermoelectron emission source 1*a* is compared to the cathode 41 of the fifth embodiment in FIG. 6, the cathode 91 has the structure similar to that of the cathode 41 except that the thermoelectron emission source 1 in FIG. 6 is the thermoelectron emission source 1*a* in the pre-heating treatment state in FIG. 5. Accordingly, the common component is designated by the identical numeral, and therefore repeated descriptions will be avoided as much as possible The cathode 91 in FIG. 15 includes the thermoelectron emission source 1*a* that is the pre-heating treatment state of the thermoelectron emission source 1, the Wehnelt 42, and the base 45 that supports the heater power input terminals 43 and 44.

The thermoelectron emission unit constituting material 20*a* of the thermoelectron emission source 1*a* includes the cylindrical main body 21 and the conical tip 22*a* having the sharply pointed shape. The flat leading end of the tip 22*a* of the thermoelectron emission unit constituting material 20*a* is exposed from part of the coating layer 23*a*.

The Wehnelt 42 is arranged so as to surround the thermoelectron emission source 1*a*. The Wehnelt 42 includes the opening through which the electron beam emitted from the thermoelectron emission source 1 after the thermoelectron emission source 1*a* is subjected to the heating treatment to become the thermoelectron emission source 1. The thermoelectron emission source 1*a* that is the pre-heating treatment state of the thermoelectron emission source 1 is supported on the base 45 while supported by the heater power input terminals 43 and 44, and the thermoelectron emission source 1*a* can be heated by the heaters 46 and 47. That is, the thermoelectron emission unit constituting material 20*a* of the thermoelectron emission source 1*a* can be heated by the heaters 46 and 47.

Whether the value of the leading end diameter of the tip 22*a* is larger than the predetermined diameter value that is the target value is checked with respect to the thermoelectron emission unit constituting material 20*a* of the thermoelectron emission source 1*a* incorporated in the cathode 91 (S305).

When the checked value of the leading end diameter falls within the range of the predetermined diameter value that is the target value, the process of producing the cathode is ended, and the flow process then moves to the next process of producing the electron beam writing apparatus (S307).

On the other hand, when the value of the leading end diameter of the tip 22*a* is larger than the predetermined diameter value, the heating treatment for the thermoelectron emission unit constituting material 20*a* is performed (S306).

The heating treatment is performed while the cathode structure is formed, namely, the cathode 91 is formed by incorporating the thermoelectron emission source 1*a* that is the pre-heating treatment state of the thermoelectron emission source 1 in the cathode 91. As described above, in the cathode 91, the thermoelectron emission unit constituting material 20*a* of the thermoelectron emission source 1*a* can be heated by the heaters 46 and 47. Accordingly, using the heaters 46 and 47, the heating treatment can be performed to the thermoelectron emission unit constituting material 20*a* and coating layer 23*a* of the thermoelectron emission source 1*a* that is the pre-heating treatment state of the thermoelectron emission source 1.

In the heating treatment, a heater other than the heaters 46 and 47 is prepared, and the heating treatment can be performed to the thermoelectron emission unit constituting material 20*a* of the thermoelectron emission source 1*a* incorporated in the cathode 91.

In the heating treatment, the tip 22*a* of the thermoelectron emission unit constituting material 20*a* of the thermoelectron emission source 1*a* is sublimed to adjust the size of the exposed flat leading end of the tip 22*a*. That is, the size of the tip 22*a* is adjusted so as to sublime through the heating treatment to decrease the leading end diameter, and the tip 22*a* is formed so as to have the predetermined diameter value that is the target value. The thermoelectron emission unit constituting material 20*a* and coating layer 23*a* of the cathode 91 becomes the thermoelectron emission source 1 in FIG. 1 through the heating treatment. As a result, the cathode 91 becomes the cathode 41 in FIG. 6 through the heating treatment, and the cathode 41 is produced.

The electron gun is produced using the produced cathode 41, and the electron beam writing apparatus can be produced by incorporating the obtained electron gun in the electron beam writing apparatus (S307). A well-known method can be applied to the electron gun and electron beam writing apparatus producing method in Step S307.

In the cathode producing method of the seventh embodiment of the present invention, the size is adjusted through the heating treatment (S306) such that the leading end diameter of the tip 22*a* of the thermoelectron emission unit constituting material 20*a* of the thermoelectron emission source 1*a* is decreased. In this case, sometimes the flat leading end of the tip 22*a* retreats onto the side on which the thermoelectron emission source 1 is attached. That is, sometimes the leading end surface of the tip 22*a* of the thermoelectron emission unit constituting material 20*a* in FIG. 15 retreats onto the side of the base 45 to form the electron emission surface.

Figure 16:
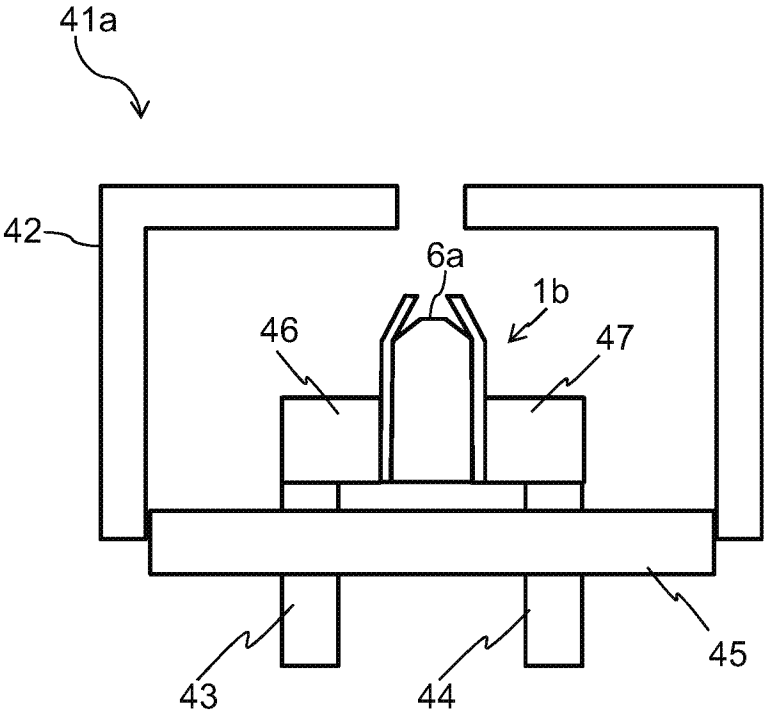
FIG. 16 is a schematic sectional view illustrating the state in which the electron emission surface of the thermoelectron emission source in the cathode according to the fifth embodiment of the present invention retreats.

FIG. 16 is a schematic sectional view illustrating the state in which the electron emission surface of the thermoelectron emission source in the cathode of the fifth embodiment of the present invention retreats.

The thermoelectron emission source 1*b* of the cathode 41*a* in FIG. 16 becomes the state in which the electron emission surface retreats due to the heating treatment. When the cathode 41*a* in FIG. 16 is compared to the cathode 41 in FIG. 6, the cathode 41*a* has the structure similar to that of the cathode 41 except that the thermoelectron emission source 1*b* in FIG. 16 differs from the thermoelectron emission source 1 in FIG. 6. Accordingly, the common component is designated by the identical numeral, and repeated descriptions will be avoided as much as possible Generally, in the cathode of the electron gun, usually a specified value that becomes a reference is provided in a distance between the Wehnelt and the electron emission surface of the thermoelectron emission source. When the distance between the Wehnelt and the electron emission surface increases to deviate from the specified value, performance of the electron gun or the electron beam control system of the electron beam writing apparatus in which the electron gun is used is degraded.

As illustrated in FIG. 15, the distance between the Wehnelt 42 and the flat leading end of the tip 22*a* of the thermoelectron emission unit constituting material 20*a* is set so as to become the specified value, and preferably the height of the thermoelectron emission source 1*b* is adjusted in the case that an electron emission surface 6*a* retreats in the thermoelectron emission source 1*a* of FIG. 16 due to the heating treatment.

A cathode producing method according to the embodiments of the invention including a process of adjusting the height of the thermoelectron emission source will be described below.

Figure 17:
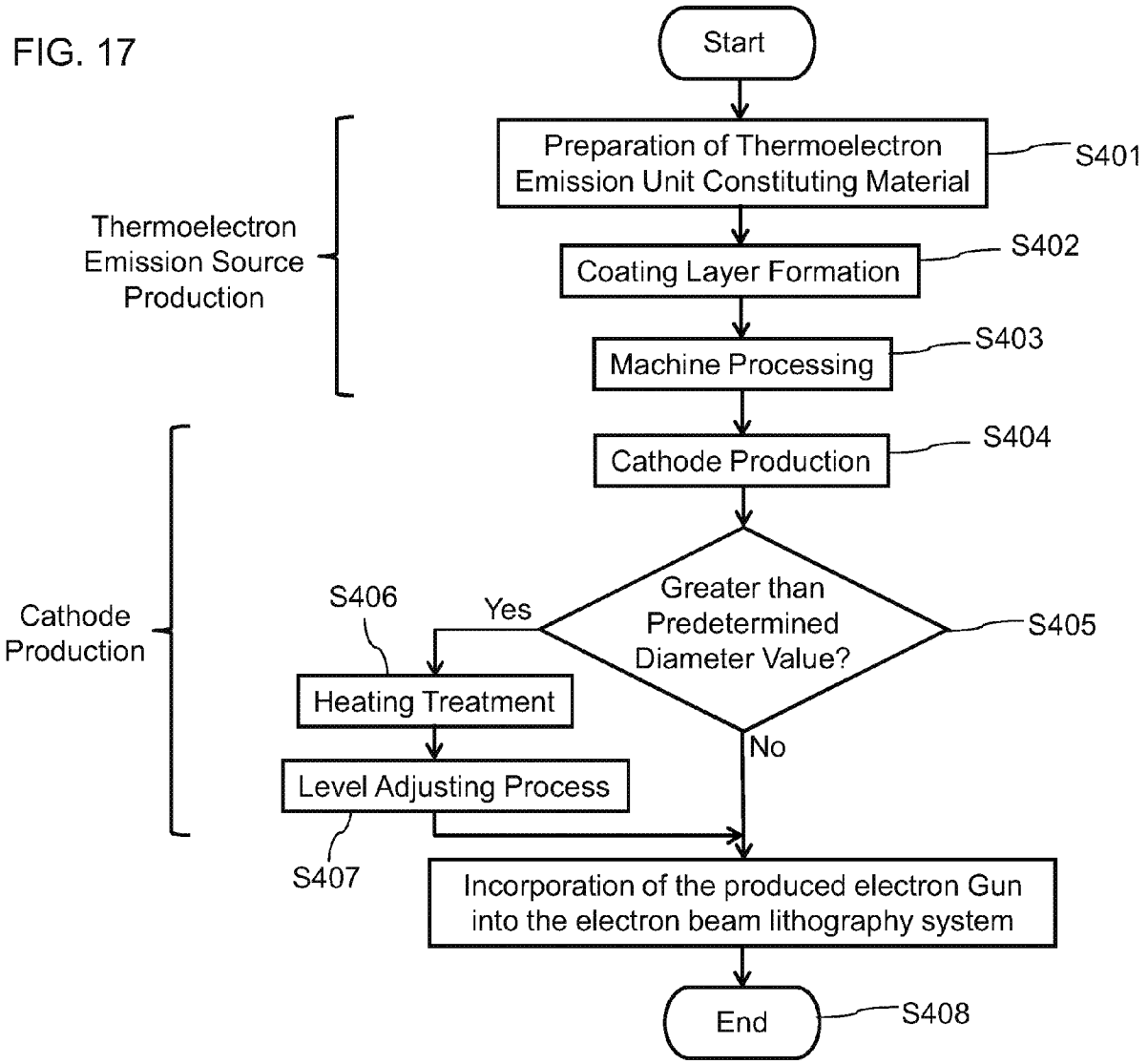
FIG. 17 is a flowchart illustrating a second example of the cathode producing method according to the seventh embodiment of the present invention.
Figure 18:
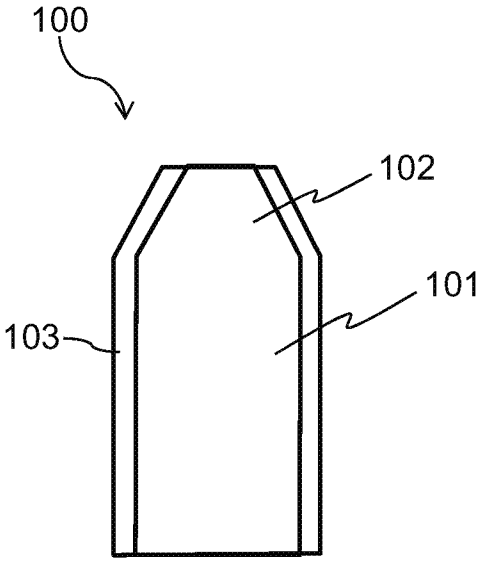
FIG. 18 is a schematic sectional view of the conventional thermoelectron emission source.
Figure 19:
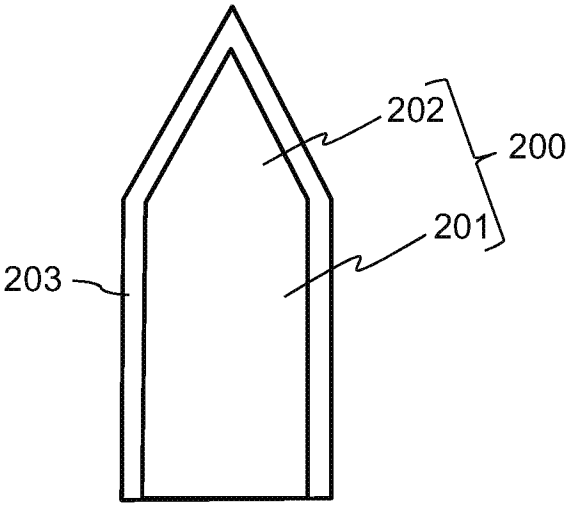
FIG. 19 is a schematic sectional view illustrating a pre-machine processing state of the conventional thermoelectron emission source.

FIG. 17 is a flowchart illustrating the second example of the cathode producing method of the seventh embodiment of the present invention.

The second example of the cathode producing method of the seventh embodiment in FIG. 17 includes the production processes similar to those of the first example of the cathode producing method of the seventh embodiment in FIG. 14. For example, the preparation of the thermoelectron emission unit constituting material in FIG. 17 (S401) is similar to Step S301 of the cathode producing method in FIG. 14, the formation of the coating layer (S402) is similar to Step S302 of the cathode producing method in FIG. 14, the machine processing (S403) is similar to Step S303 of the cathode producing method in FIG. 14, the cathode production (S404) is similar to Step S304 of the cathode producing method in FIG. 14, the process of determining whether the leading end diameter is larger than the predetermined diameter value (S405) is similar to Step S305 of the cathode producing method in FIG. 14, the heating treatment (S406) is similar to Step S306 of the cathode producing method in FIG. 14, and the incorporation of the electron gun in the electron beam writing apparatus (S408) is similar to Step S307 of the cathode producing method in FIG. 14.

That is, the second example of the cathode producing method of the seventh embodiment in FIG. 17 is similar to the first example of the cathode producing method of the seventh embodiment in FIG. 14 except that the height adjusting process (S407) is provided in order to adjust the height of the thermoelectron emission source 1*b* after the heating treatment process (S406). Accordingly, repeated description will be avoided as much as possible In the second example of the cathode producing method of the seventh embodiment of the present embodiment, after the heating treatment process in Step S406, the process of adjusting the height of the thermoelectron emission source 1*b* in FIG. 16 is provided (S407), and the height of the electron emission surface 6*a* is adjusted in the cathode 41*a*.

As a result, in the cathode 41*a*, the distance between the Wehnelt 42 and the electron emission surface 6*a* of the thermoelectron emission source 1*b* falls within the range of the specified value that becomes the reference. The degradation of the performance of the electron gun in which the cathode 41*a* is used can be restrained, and the degradation of the electron beam control system of the electron beam writing apparatus in which the electron gun is used can be restrained.

In the second example of the cathode producing method of the seventh embodiment of the present invention, there are two methods for adjusting the height of the thermoelectron emission source 1*b*.

A first method is one that moves the base 45 to which the thermoelectron emission source 1*b* is attached. That is, base 45 is moved, and the Wehnelt 42 is fixed to the base 45 by a screw (not illustrated) when the distance between the Wehnelt 42 and the electron emission surface 6*a* of the thermoelectron emission source 1*b* falls within the range of the specified value. By the method, the distance between the Wehnelt 42 and the electron emission surface 6*a* of the thermoelectron emission source 1*b* in the cathode 41*a* can be set within the range of the specified value that becomes the reference.

A second method is one in which a gap adjusting shim is used. In the usual cathode, the Wehnelt and the base are fixed to each other by the screw to decide the distance between the Wehnelt and the electron emission surface of the thermoelectron emission source. Accordingly, in the second method, the Wehnelt 42 and the base 45 are fixed to each other by the screw with the gap adjusting shim interposed therebetween, and the distance between the Wehnelt 42 and the electron emission surface 6*a* of the thermoelectron emission source 1*b* supported by the base 45 is adjusted by action of the gap adjusting shim. As a result, in the cathode 41*a*, the distance between the Wehnelt 42 and the thermoelectron emission source 1*b* can be set within the range of the specified value that becomes the reference.

In Step S407 after the heating treatment process in Step S406, the height of the thermoelectron emission source 1*b* in FIG. 16 can be adjusted by the first and second methods, and the distance between the Wehnelt 42 and the electron emission surface 6*a* of the thermoelectron emission source 1*b* can be set within the range of the specified value that becomes the reference in the cathode 41*a*.

According to the thermoelectron emission source producing method of the second embodiment of the present invention, even if the diameter of the electron emission surface of the thermoelectron emission source is larger than the specification value of design in the machine processing process, the diameter of the electron emission surface can easily be adjusted without discarding the thermoelectron emission source. Therefore, according to the invention, the production yield of the thermoelectron emission source can be improved. As a result, according to the invention, the cathode can be produced with high production efficiency, and further according to the invention, the electron gun can be produced with high production efficiency.

The present invention is not limited to the above embodiments and may be modified in various forms without departing from the scope of the invention.

The above description of the present embodiments have not specified material construction, apparatus constructions, control methods etc., which are not essential to the description of the invention, since any suitable material construction, apparatus construction, control methods etc., can be employed to implement the invention. Further, the scope of this invention encompasses all producing methods employing the elements of the invention and variations thereof, which can be designed by those skilled in the art.

What is claimed is:

1. A method for producing a thermoelectron emission source for an electron gun used in an electron beam writing apparatus comprising:

preparing a first material that emits a thermoelectron;

coating the first material with a second material having a work function larger than that of the first material;

exposing the first material from part of the second material by machine processing; and decreasing a diameter of the exposed portion of the first material by providing heating treatment to the first material when the diameter of the exposed portion is larger than a predetermined diameter value.

2. The thermoelectron emission source producing method according to claim 1, wherein the first material is metal hexaboride or tungsten.

3. The thermoelectron emission source producing method according to claim 1, wherein the second material is a carbon (C) material.

4. A method for producing a thermoelectron emission source for an electron gun used in an electron beam writing apparatus comprising:

preparing a first material that emits a thermoelectron;

coating the first material with a second material having a work function larger than that of the first material;

exposing the first material from part of the second material by machine processing such that a diameter of the exposed portion of the first material is larger than a predetermined diameter value; and decreasing the exposed portion of the first material by providing heating treatment to the first material such that the diameter of the exposed portion of the first material becomes the predetermined diameter value.

5. The thermoelectron emission source producing method according to claim 4, wherein the first material is metal hexaboride or tungsten.

6. The thermoelectron emission source producing method according to claim 4, wherein the second material is a carbon (C) material.

7. A method for producing a thermoelectron emission source for an electron gun used in an electron beam writing apparatus comprising:

preparing a first material that emits a thermoelectron, wherein the first material includes a cylindrical main body and a conical tip having a flat leading end;

forming a sacrifice film on a surface of the tip of the first material;

coating an outer circumferential surface of the main body of the first material and a conical surface of the tip of the first material with a second material having a work function larger than that of the first material;

removing the sacrifice film to expose the leading end of the tip of the first material from the second material, and forming a gap between the conical surface of the tip of the first material and the second material; and decreasing a diameter of the exposed leading end of the tip of the first material by providing heating treatment to the first material when the diameter of the exposed leading end is larger than a predetermined diameter value.

8. The thermoelectron emission source producing method according to claim 7, wherein the first material is metal hexaboride or tungsten.

9. The thermoelectron emission source producing method according to claim 7, wherein the second material is a carbon (C) material.

10. The thermoelectron emission source producing method according to claim 7, wherein the sacrifice film is an organic film.

11. A method for producing a cathode for an electron gun used in an electron beam writing apparatus comprising:

preparing a thermoelectron emission source in which a first material that emits a thermoelectron is exposed from part of a second material having a work function larger than that of the first material while the first material is coated with the second material;

forming a cathode structure by incorporating the thermoelectron emission source in the cathode structure; and forming the thermoelectron emission surface by providing heating treatment to the first material of the cathode structure such that a diameter of the exposed portion of the first material of the thermoelectron emission source incorporated in the cathode structure becomes a predetermined diameter value by decreasing the diameter of the exposed portion.

12. The cathode producing method according to claim 11, further comprising adjusting a height of the thermoelectron emission surface after the heating treatment.

* * * * *